US005280322A

United States Patent [19]

Kono

[11] Patent Number: 5,280,322

[45] Date of Patent: Jan. 18, 1994

[54] IMAGE FORMING APPARATUS WITH SHEET JAM DETECTION

[75] Inventor: Hiroshi Kono, Shijonawate, Japan

[73] Assignee: Mita Industrial Co., Ltd., Osaka, Japan

[21] Appl. No.: 77,498

[22] Filed: Jun. 17, 1993

Related U.S. Application Data

[63] Continuation of Ser. No. 843,225, Feb. 28, 1992, abandoned.

[30] Foreign Application Priority Data

Mar. 12, 1991 [JP] Japan ..... 3-073883

[51] Int. Cl.[5] ..... G03G 21/00

[52] U.S. Cl. ..... 355/206; 355/316; 271/259

[58] Field of Search ..... 355/205, 206, 316; 271/258, 259

[56] References Cited

U.S. PATENT DOCUMENTS 4,937,622 6/1990 Makiura ..... 355/206

5,084,737 1/1992 Hagen et al. ..... 355/274

*Primary Examiner*—Michael L. Gellner

*Assistant Examiner*—Patrick J. Stanzione

*Attorney, Agent, or Firm*—Beveridge, DeGrandi, Weilacher & Young

[57] ABSTRACT

An image forming apparatus includes an image forming unit which has a rotating photoconductor, and a transfer unit disposed adjacent the photoconductor which retains an image-formation sheet on its circumferential surface. It further includes a sheet feeding path for feeding a sheet to the transfer unit, a sheet discharging path for discharging a sheet from the transfer unit, a first sensor for detecting a jammed-sheet condition in the sheet feeding path, a second sensor for detecting a jammed-sheet condition in the sheet discharging path, and assume function which assumes a paper jam in the transfer unit in conjunction with the determination of the first detecting sensor and/or the second detecting sensor. Accordingly, the apparatus does not neglect to cope with a sheet remaining on the transfer unit under a halt condition due to the sheet-jam. Thus obstruction to a following copying operation by a sheet remaining on the transfer unit is averted after the jammed-sheet condition is remedied.

25 Claims, 8 Drawing Sheets

IMAGE FORMING APPARATUS WITH SHEET JAM DETECTION

This application is a continuation of application Ser. No. 07/843,225, filed Feb. 28, 1992, which application is entirely incorporated herein by reference, now abandoned.

BACKGROUND OF THE INVENTION

The present invention relates to an image forming apparatus, more particularly an image forming apparatus having a transfer unit on which a sheet to be image-processed is circumferentially retained.

One class of full-color copying machines has a transfer drum provided opposite to a photoconductor drum. A printing sheet is wound onto the circumferential surface of the transfer drum, wherein four successive images developed on the photoconductor drum are transferred in turn onto the printing sheet corresponding to four toner colors, i.e. yellow, magenta, cyan and black. A full-color toner image thus formed on the printing sheet is fixed in a fixing unit.

In operation, a sheet contained in a feed cassette in the full-color copying machine is transported to the transfer drum through a feed path, rotated with the transfer drum four times, and then discharged through a discharge path having the fixing unit.

If a sheet jam is detected in the feed path or the discharge path, the sheet jam is indicated on an operation panel and the copying operation is interrupted. Then, an operator removes the jammed sheet and presses on a reset switch, whereupon the copying operation is restarted.

Since high-speed type full-color copying machines handle a plurality of printing sheets concurrently, a printing sheet may exist on the transfer drum in addition to a previous sheet in the discharge path or to a subsequent sheet in the feed path. Under these circumstances, when a sheet jam is detected in the feed path or discharge path, it can happen that a further printing sheet remains on the transfer drum though the sheet jam has been cleared.

There is a sensor for detecting the presence of a sheet on the transfer drum, but in some instances the sheet as positioned on the halted transfer drum is in a region outside of that in which the sensor can detect it. As a result, restart of the copying operation is allowed even if a printing sheet is retained on the transfer drum, such that the printing sheet thus remaining becomes an obstruction to an ensuring operation.

SUMMARY OF THE INVENTION

An object of the invention is to reliably detect a sheet-jamming condition on the transfer drum of an image-forming apparatus.

According to the present invention, an image forming apparatus includes an image forming unit which has a rotating photoconductor, and a transfer unit disposed adjacent the photoconductor which retains a sheet on a circumferential surface thereof; a sheet feeding path for feeding a sheet to the transfer unit; and a sheet discharging path for discharging a sheet therefrom. It further includes a first sensor for detecting a sheet jam in the sheet feeding path, a second sensor for detecting a sheet jam in the sheet discharging path, and an assume means which assumes, or register, a paper jam in the transfer unit in conjunction with the determination of the first detecting sensor and/or the second detecting sensor.

Wherein the first detecting sensor and/or second detecting sensor detects a jammed sheet along the corresponding paths, another sheet may yet exist on the transfer unit. Therefore, the assume means assumes, or registers, that there is a sheet remaining on the transfer unit, and accordingly the apparatus will not fail to detect the presence of such a sheet.

The foregoing and other objects and advantages of the present invention will be more fully apparent from the following detailed description.

DESCRIPTION OF THE PREFERRED EMBODIMENT

Figure 1:
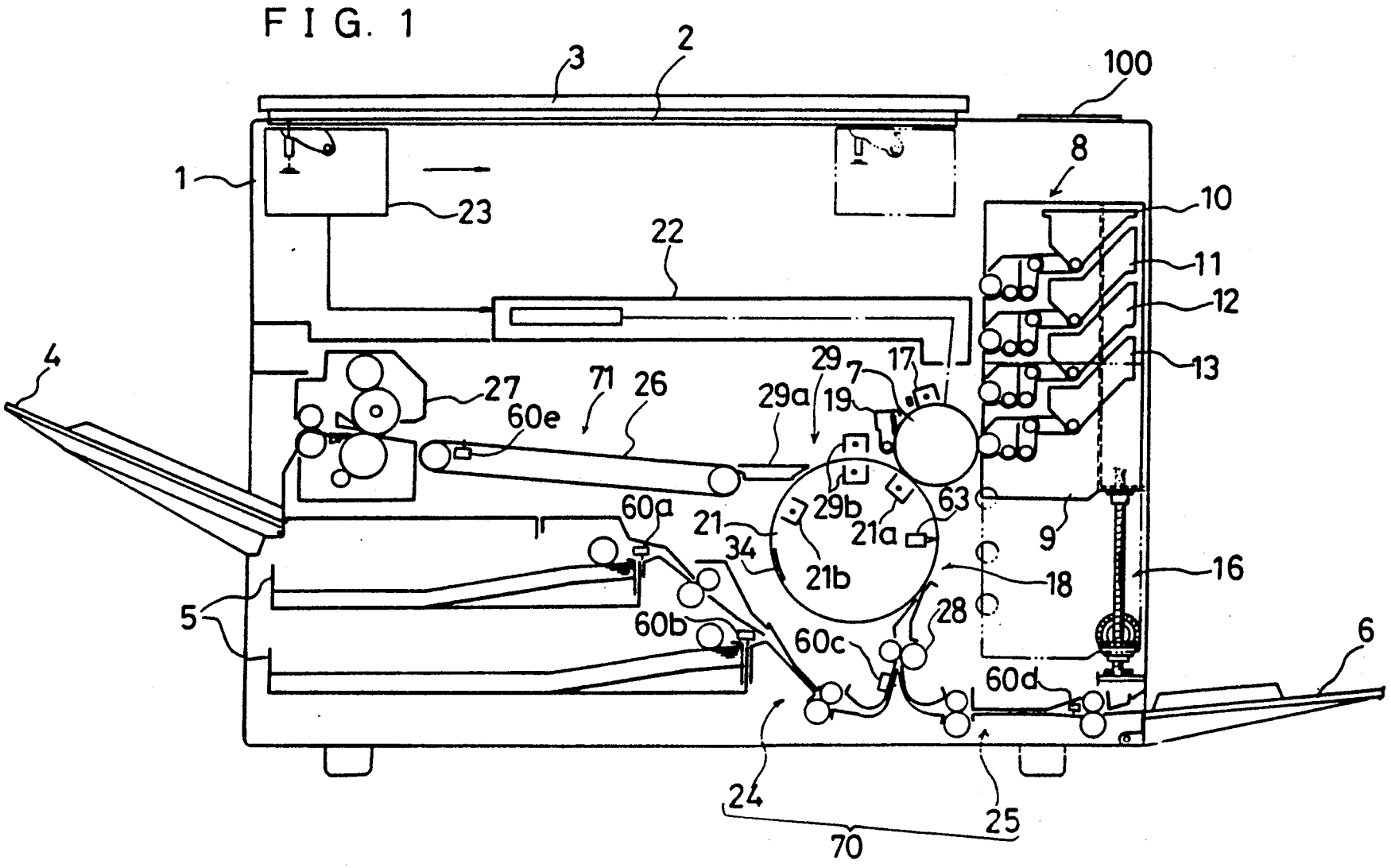
FIG. 1 is a schematic elevational view of a full-color copying machine according to the present invention.

Referring to FIG. 1, an illustrative full-color copying machine is shown having an original retainer disposed in the upper portion of the copying machine body 1, and an original cover 3 hinge-mounted on top of the original retainer 2. An operation panel 100 is provided beside the original cover 3 stop the copying machine body 1. A copy tray 4 and a pair of feed cassettes 5 are provided within the left portion in the figure of the machine body, and a bypass feed tray 6 is provided attached to the right side thereof.

A photoconductor drum 7, disposed in the interior of the machine body 1, is surrounded by a charger 17, a transfer unit 18 and a cleaning unit 19, and by an adjacent developing section 8 as well, which includes vertically arranged developing units 10, 11, 12 and 13. These developing units 10 to 13 are supported by a movable frame 9, which is vertically conveyed by means of a moving mechanism 16.

Disposed over the photoconductor drum 7 is a laser unit 22 which emits a laser beam onto the upper drum surface. Between the laser unit 22 and the original retainer 2, an image reader 23 comprising charge-coupling devices (CCDs) is disposed. The image reader 23 is driven to reciprocate horizontally in the figure, so as to scan an original placed on the original retainer 2. The image information thus obtained by the image reader 23 is supplied as electrical signals to the laser unit 22.

A transfer drum 21 is disposed adjacent to the photoconductor drum 7. Under the transfer drum 21, and between the feed cassettes 5 and the bypass feed tray 6, are sheet feeding paths 70, which comprise sheet transport mechanisms 24 and 25 consisting of guide plates and transport rollers. Disposed between the transfer drum 21 and the copy tray 4 is a sheet discharging path 71 which includes a sheet transport mechanism 26 and an image fixing unit 27, in that order from the transfer drum 21. Separation claws 29*a* associated with a separation unit 29 for separating a printing sheet from the transfer drum 21 are provided between the transfer drum 21 and the sheet transport mechanism 26.

Sheet-detecting sensors 60*a*, 60*b* and 60*d* are provided in openings of the sheet feeding paths 70 adjacent to the feed cassettes 5 and the bypass feed tray 6, and another sheet-detecting sensor 60*c* is provided just below resist rollers 28 in a portion of the sheet feeding paths 70 under the transfer drum 21. Yet another sheet-detecting sensor 60*e* is provided at the end of the sheet transport mechanism 26 near the image fixing unit 27, in order to detect the presence of a printing sheet at the image fixing unit 27. These sensors are, for example, limit switches.

Figure 2:
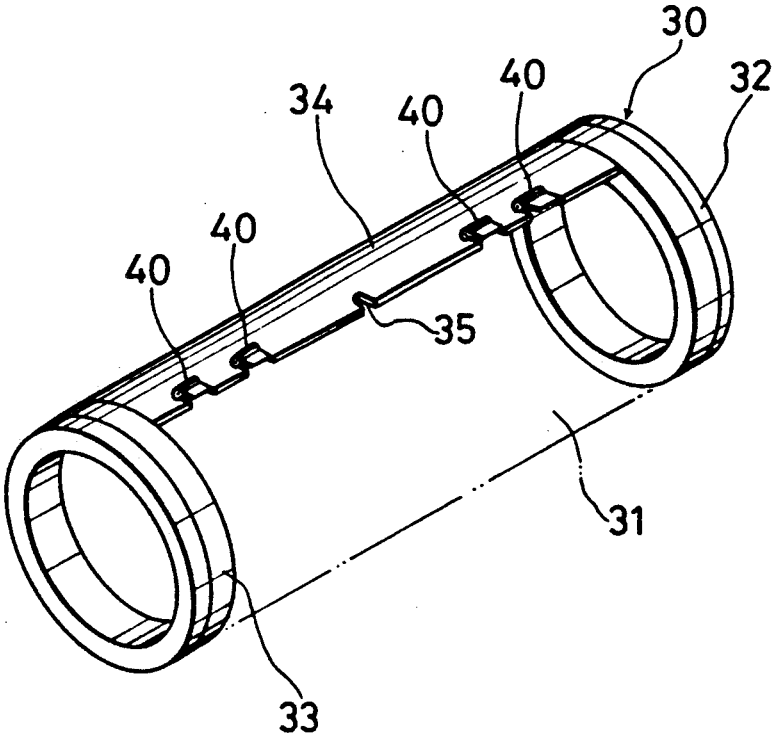
FIG. 2 is a perspective view of a transfer drum.

The transfer drum 21 essentially consists of a drum frame 30 and a cylindrically wound retaining material 31, as diagramed in FIG. 2. The drum frame 30 consists of opposed end rings 32 and 33 located at either end of the drum, and a link plate 34 connected between the end rings 32 and 33. In the middle of the link plate 34 is a notch 35 through which light from a sheet sensor 63 passes (as described in the following), and along the plate are nippers 40 for nipping one end of a printing sheet.

Around the retaining material 31 of the transfer drum 21, a transfer charger 21*a* and an electrification charger 21*b*, both belonging to the transfer unit 18, and an opposed pair of separation chargers 29*b*, belonging to the separation unit 29, are disposed as shown in FIG. 1. The sheet sensor 63 is provided within the transfer drum 21 to detect the presence of a printing sheet on the transfer drum 21. The sheet sensor 63 is a reflex-type photoelectric sensor which detects the presence of a sheet by receiving its reflected light.

Figure 3:
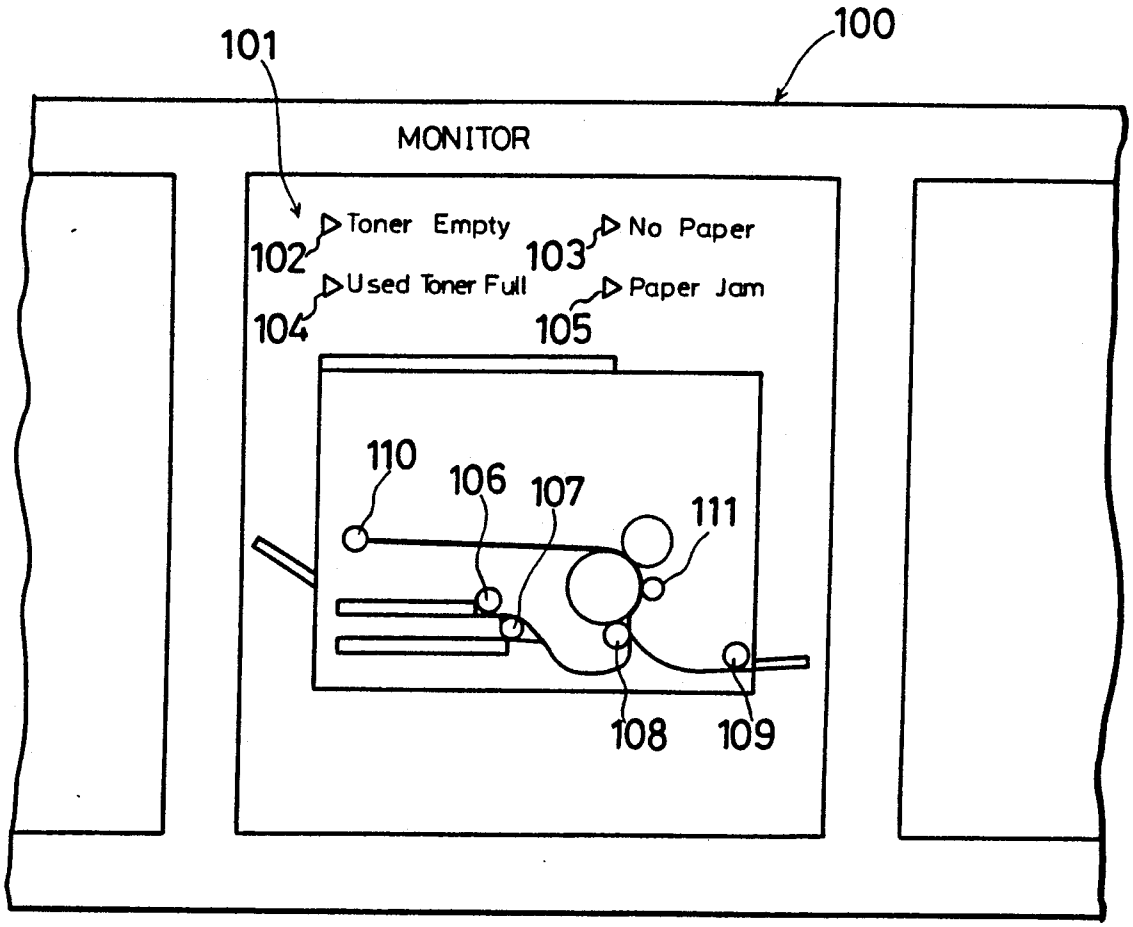
FIG. 3 is an enlarged view showing a portion of an operation panel.

Referring to FIG. 3, the operation panel 100 is shown to have a display 101, and has additionally several other keys such as a print key and numerical keys. The display 101 functions to indicate "Paper Jam", "No Paper", "Toner Empty", "Waste Toner Full", etc. in order to alert an operator to such conditions. The display 101 includes, as shown in the upper portion, LEDs 102–105 corresponding to the indicators, and LEDs 106–111 in a schematic depiction of the copying machine, as shown in the lower portion. The LEDs 106–111 indicate the positions of sheet jam as detected by the corresponding sensors 60*a*–60*e* and 63.

Figure 4:
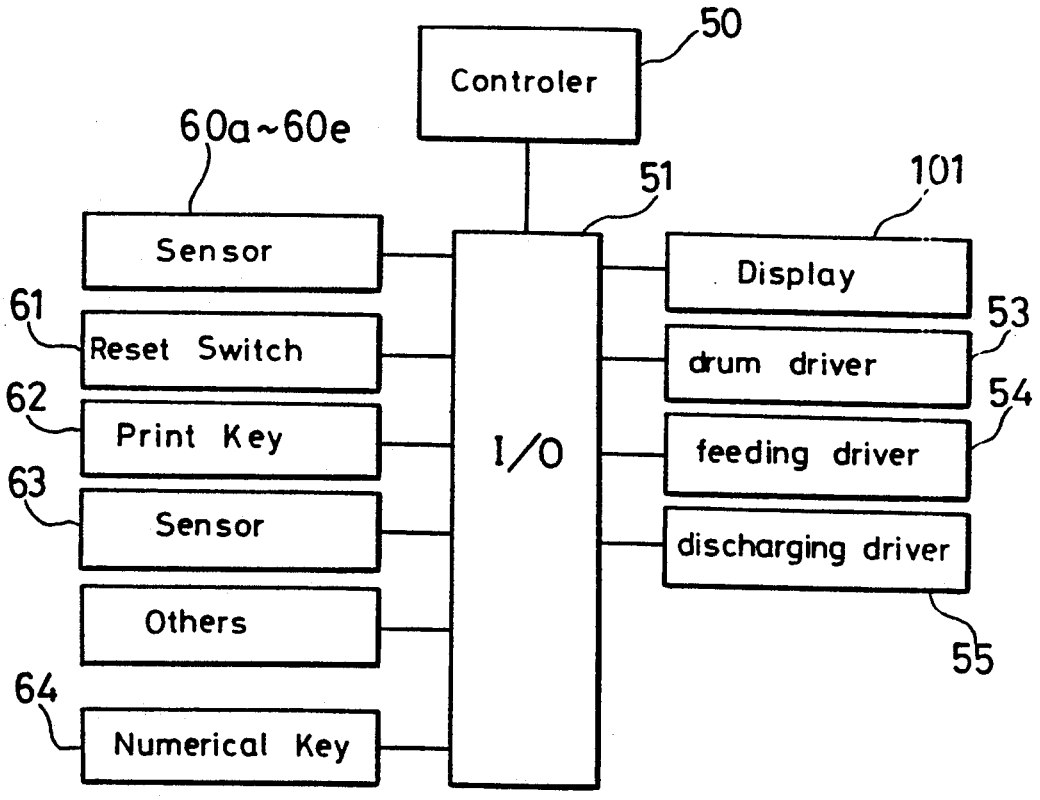
FIG. 4 is a schematic diagram of a control unit.

Reference is now made to FIG. 4, which shows a controller 50 of the copying machine. The controller 50 consists of a microcomputer which includes a CPU, a RAM and a ROM, and is connected through an I/O port 51, keys 62 and 64 of the operation panel 100, the sensors 60*a*–60*e* and 63, a reset switch 61, and other associated parts. Furthermore, the controller 50 is connected through the I/O port 31 to the display 101, a drum driver 53, a feed driver 54 and a discharge driver 55. The reset switch 61 is provided for restarting the copying operation after remedying a sheet jam. The print key 62 is provided for starting a copying operation, and the numerical keys 64 are provided for setting such instructions as the number of copies. The drum driver 53 drives the photoconductor drum 7 and transfer drum 21 to rotate; the feed driver 54 drives rollers provided in the feeding paths 70; and the discharge driver 55 drives the sheet transport mechanism 26 and image fixing unit 27 provided in the sheet-discharging path 71.

Operation of this full-color copying machine will now be described, referring to the program illustrated by the flow charts diagramed in FIGS. 5 and 6A–6C.

Figure 5:
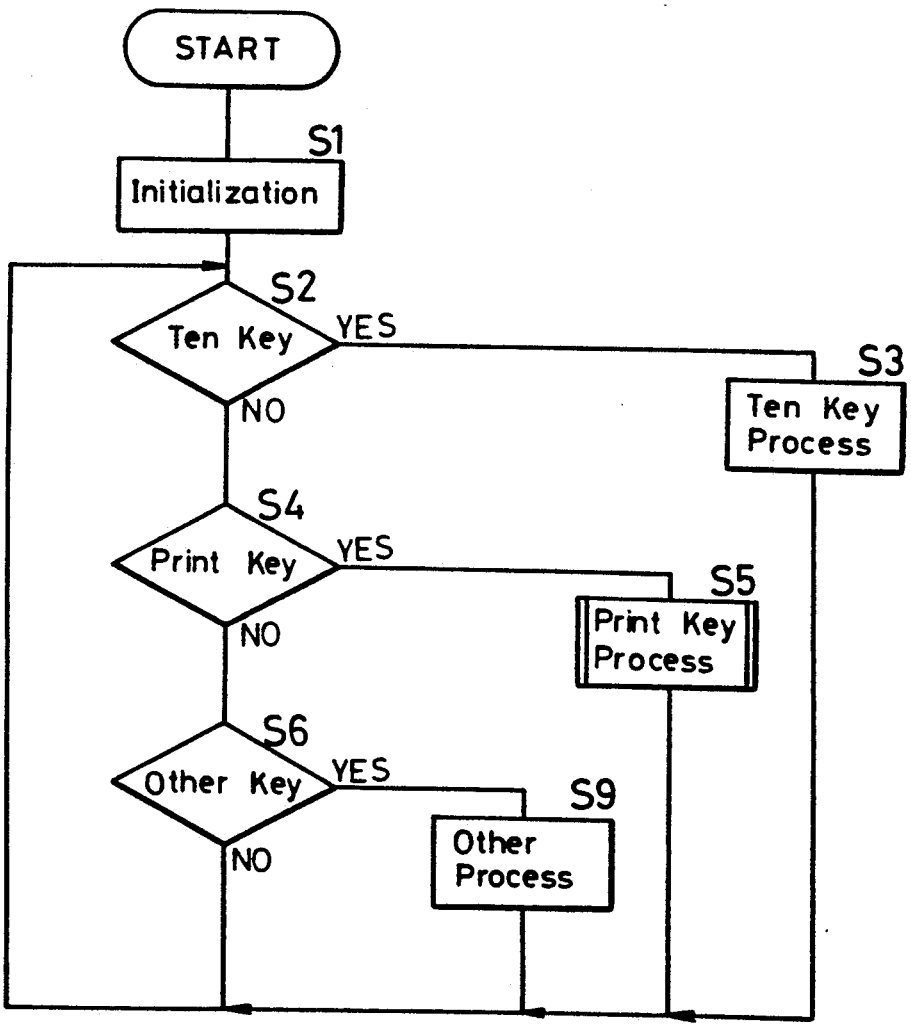
FIG. 5 is a control process flow chart of the main routine controlling the copying machine.

As the main switch (not shown) of the copying machine is turned on, an initialization is executed at step S1 of FIG. 5, wherein the designated number of copies is set at "1", and the designated development color is set as "black".

Figure 6A:
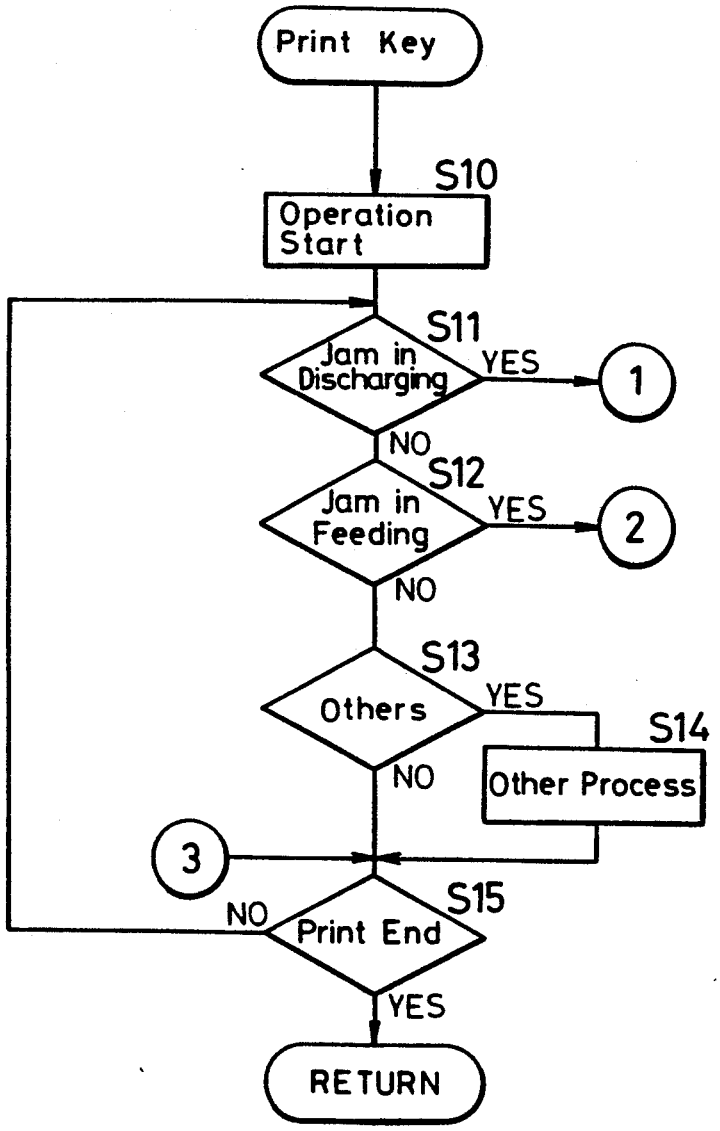
FIGS. 6A to 6C are control process flow charts controlling the printing operation of the copying machine.
Figure 6B:
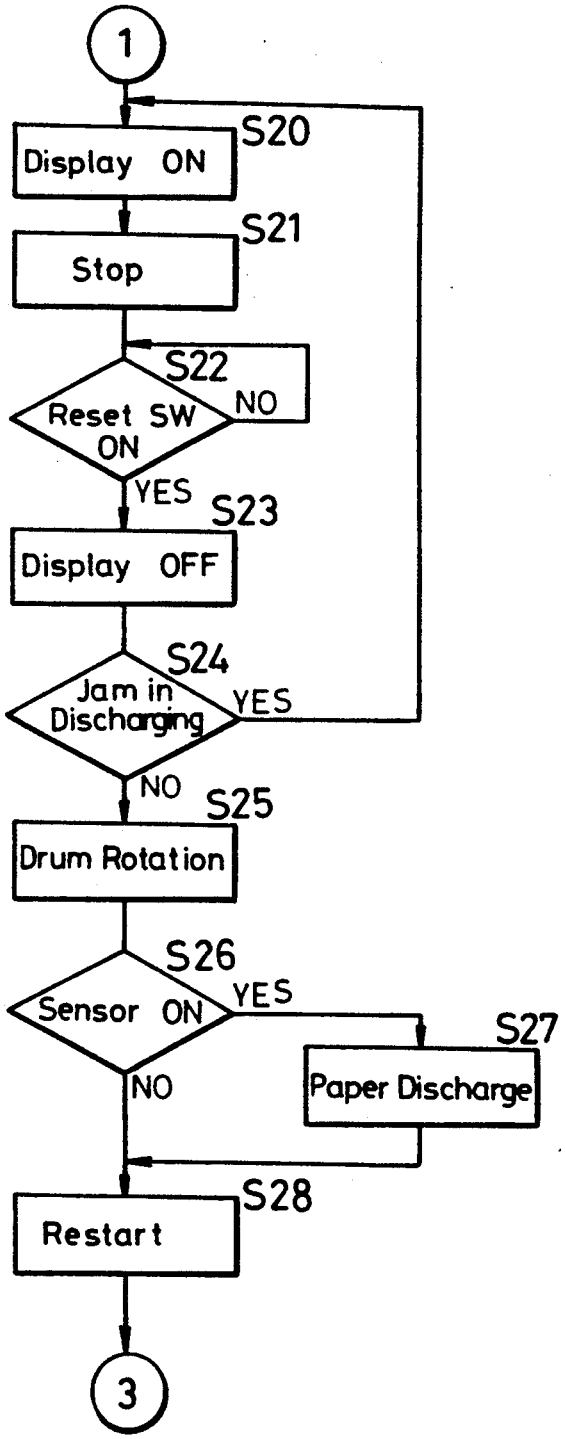
Figure 6C:
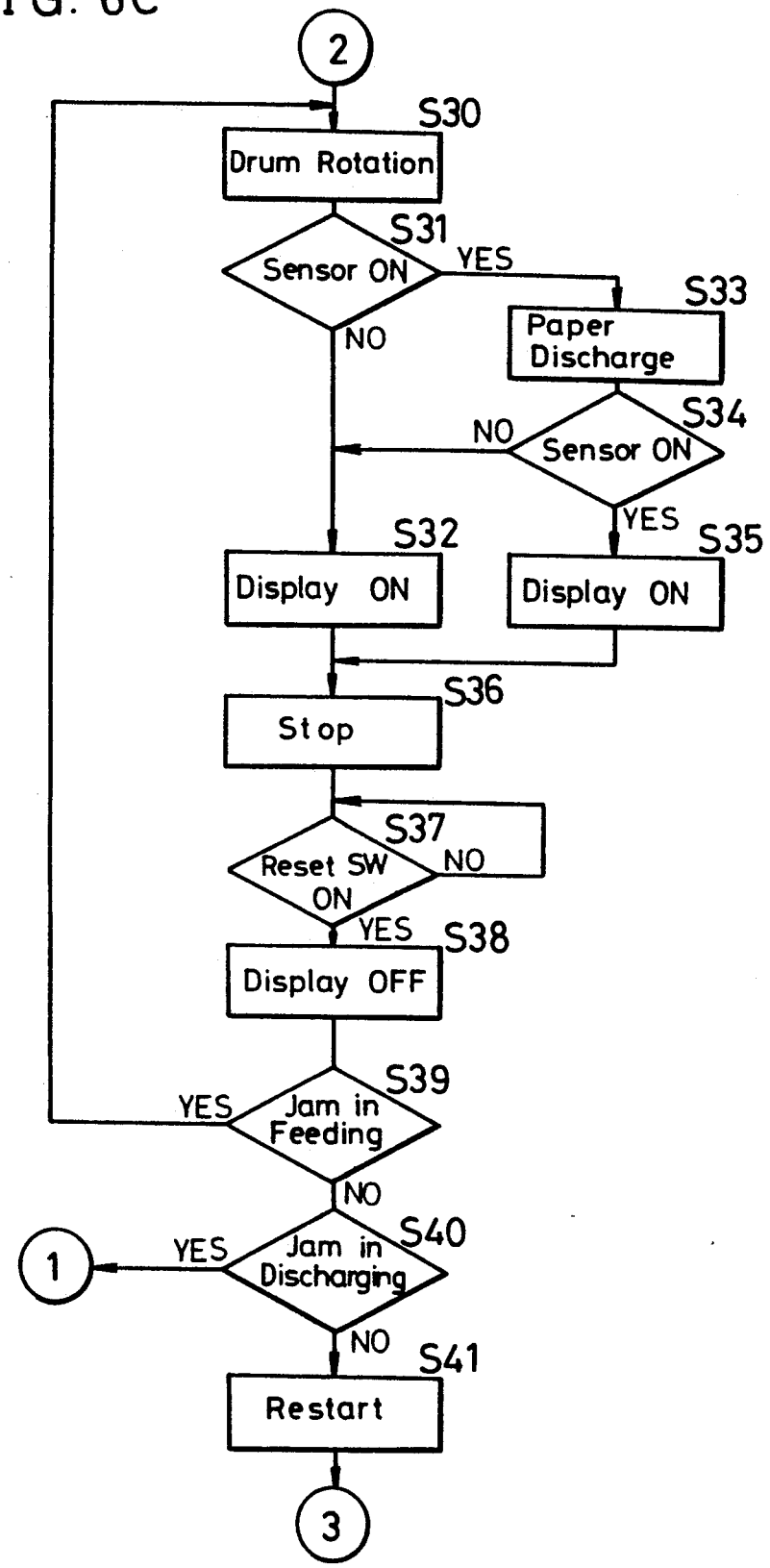

At step S2, it is determined whether one of the numerical keys 64 has been pressed. Since the numerical keys 64 can be employed for designating number of the copies and for other instructions, a process including the designation of the number of copies in correspondence with those keys which may have been pressed is carried out at step S3, and then the program returns to step S2. If none of the keys 64 is found to have been pressed at step S2, it is determined at step S4 whether the print key 62 has been pressed. Since the print key 62 is the key for commanding the start of the copying operation as described in the foregoing, a printing process is executed at step S5, and then the program returns to step S2. If the print key 62 is found not to have been pressed at step S4, it is determined at step S6 whether any of the miscellaneous keys has been pressed. In an instance in which one of the miscellaneous keys has been pressed, the appropriate miscellaneous process corresponding to the pressed key is executed at step S9, and then the program returns to step S2.

Wherein the print key 62 has been pressed, the program proceeds through step S4 to step S5, at which the print key process diagramed in FIGS. 6A–6C is executed.

At step S10 in FIG. 6A, the start of a copying operation is commanded. Then, it is determined at step S11 whether there is a sheet jam in the discharging path 71. A sheet jam occurring in the sheet discharging path 71 is detected through the elapse of a predetermined period of continuous activation time after the sheet detecting sensor 60*e* is switched on. There being no sheet jam detected in the sheet discharging path 71, it is determined at step S12 whether there is a sheet jam in the sheet feeding paths 70. A sheet jam in the sheet feeding paths 70 is detected through the elapse of a predetermined period of unbroken activation time after any of the sheet detecting sensors 60*a*, 60*b*, 60*c* and 60*d* is switched on.

There being no sheet jam detected in the sheet feeding paths 70, it is determined at step S13 whether any miscellaneous processes are to be executed. If none of the miscellaneous processes has been instructed, it is determined at step S15 whether all the commanded copy operations have been completed. Wherein any of the miscellaneous processes is requested, the program proceeds from step S13 to step S14, at which the requested miscellaneous process is executed. When, at step S15, all the copy processes have been completed, the program returns to the main routine diagramed in FIG. 5. Meanwhile, when it is found that further copying operations remain commanded at step S15, the program returns to step S12.

When a sheet jam is detected in the sheet discharging path 71, the program proceeds from step S11 to step S20 of FIG. 6B. At step S20 an indication process is executed, which includes switching on the LED 105, to signal the presence of a sheet jam, and the LED 110 on the display 101, which corresponds to the sensor 60*e*. Then, at step S21, the copying operation is halted. When it is determined that the reset switch 61 has been operated, the indicating LEDs are switched off at step S23. Subsequently, it is determined at step S24 whether any sheet jam in the sheet discharging path 71 has been detected; in which case the determination is affirmative, the program returns to step S20. There being no sheet jam detected at step S24, the transfer drum 21 is rotated a predetermined number of revolutions at step S25. Then, it is determined at step S26 whether the sensor 63 was switched on during the rotation of the transfer drum 21. If this is the case, that is, if a sheet jam has arisen in the transfer unit 18, a process for discharging the jammed sheet is executed at step S27. Following the sheet-discharging operation, or if the sensor 63 has not been activated at step S26, step S28 proceeds, at which the copying operation is restarted. Then, the program goes back to step S15 of FIG. 6A.

In an instance in which a sheet jam in the sheet feeding paths 70 is detected at step S12 of FIG. 6A, step S30 of FIG. 6C is executed whereby the transfer drum 21 is rotated a predetermined number of revolutions. Then, it is determined at step S31 whether the sheet sensor 63 has been switched on. During the execution of step S30 and step S31, only the transfer drum 21 is rotated, and the other moving parts remain halted. When at step S31 it is found that the sheet sensor 63 has been turned on, step S33 is executed, whereby the transfer drum 21 is rotated and the sheet wound about the transfer drum 21 is discharged. Then, at step S34, again the determination is made as to whether the sheet sensor 63 has been switched on while the transfer drum 21 was still rotated for a while after the sheet discharging operation at step S33. If the sheet sensor 63 is found to have been turned on at step S34, step S35 is executed, whereby the LED 105 indicating a sheet jam, the one of the LEDs 106–109 corresponding to the sensor among the sensors 60*a*–60*d* which has detected the sheet jam in the sheet feeding paths 70, and the LED 111 corresponding to the sensor 63, are switched on. Otherwise, the sensor 63 not having gone on at either step S31 or S34, step S32 is executed, whereby the LED 105 indicating sheet jam and the appropriate LED among the LEDs 106–109, corresponding to the sensor among the sensors 60*a*–60*d* which has detected the sheet jam in the sheet feeding paths 70, are switched on, the LED 111 being excepted.

After the execution of either step S32 or S35, step S36 is executed, halting the copying operation and inactivating the copying machine. At step S37, the program awaits the activation of the reset switch 61 by an operator. When the reset switch 62 is pressed, step S38 is executed, switching off the LEDs of the display 101, following which step S39 is executed, whereby it is determined again whether there is any sheet jam remaining in the sheet feeding paths 70. If a sheet jam is detected remaining in the sheet feeding paths 70, the program returns to step S30. There being sheet jam detected in the sheet feeding paths 70, step S40 is executed, whereby it is determined again whether or not the sheet discharging path 71 is clear of any sheet jam.

The evaluations concerning sheet jam at steps S39 and S40 are made in order to confirm whether any and every sheet jam has been completely remedied. When any other sheet jam is detected at step S40, step S20 of FIG. 6B is executed. Otherwise, step S41 is executed, whereby the copying operation is restarted, activating the copying machine, whereupon the program returns to step S15 of FIG. 6A.

Thus, since it is possible that the sensor 63 will not detect be a sheet over a portion of the transfer drum 21 when a sheet jam is detected in either the sheet feeding paths 70 or sheet discharging path 71, the determinations at steps S26 and S31 are carried out to confirm whether a copy sheet in fact remains wound on the transfer drum 21. Then, in case there is a sheet on the transfer drum 21, steps S27 and step S33 are executed to discharge the sheet automatically. Accordingly, no sheet will remain on the transfer drum 21 after the remedying of the sheet jam in the sheet feeding paths 70 or sheet discharging path 71.

MODIFICATIONS (a) When a sheet jam arises in either the sheet feeding paths 70 or sheet discharging path 71, the operation to discharge a sheet from the transfer drum 21 may be carried out without determining whether there is in fact a sheet on the transfer drum 21 by programming it to rotate the transfer drum 21 in conjunction with the detection of a sheet jam in the sheet feeding paths 70 or sheet discharging path 71. Thus the presence of a sheet on the transfer drum is therein assumed or registered.

(b) When a sheet jam arises in either the sheet feeding paths 70 or sheet discharging path 71, the display 101 may be made to indicate a presumed sheet jam in the transfer unit 18, in lieu of performing an operation to discharge a sheet from the transfer drum 21.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An apparatus for forming an image comprising:
   - image-formation means including a rotating photoconductor, and an image transfer unit retaining a sheet on its circumferential surface;
   - a sheet-feeding path for feeding a sheet to said transfer unit;
   - a sheet-discharging path for discharging the sheet from said transfer unit;
   - first detecting means for detecting a jammed-sheet condition in said sheet-feeding path;
   - second detecting means for detecting a jammed-sheet condition in said sheet-discharging path; and
   - sheet jam registering means which registers a jammed-sheet condition in either said sheet-feeding path or said sheet-discharging path, and which registers a jammed-sheet condition in said image transfer unit upon detection of a jammed sheet condition in said sheet-feeding path by said first detecting means or upon detection of a jammed sheet condition in said sheet-discharging path by said second detecting means.

2. An apparatus according to claim 1, wherein said first detecting means includes a first sensor disposed in said sheet-feeding path, whereby a jammed-sheet condition occurring in said sheet-feeding path is concluded after a predetermined period of continuous detection by said first sensor has elapsed.

3. An apparatus according to claim 2, wherein said second detecting means includes a second sensor disposed in said sheet-discharging path, whereby a jammed-sheet condition occurring in said sheet-discharging path is concluded after a predetermined period of continuous detection by said second sensor has elapsed.

4. An apparatus according to claim 3, wherein said sheet-jam registering means includes a third sensor provided adjacent to said transfer unit, for detecting the presence of a sheet held in circumferential retention by said transfer unit.

5. An apparatus according to claim 4, wherein said sheet-jam registering means concludes the existence of a jammed-sheet condition in said transfer unit when said first detecting means and/or said second detecting means determines the existence of a jammed-sheet condition, and when said third sensor determines the existence of a jammed-sheet condition through the detection of the presence of a sheet by said third sensor.

6. An apparatus according to claim 5, further including means for halting an image-forming operation of the apparatus when said first and/or second detecting means detects the presence of a jammed-sheet condition; and means for restarting of the image-forming operation.

7. An apparatus according to claim 6, wherein said restarting means activates said transfer unit to discharge a sheet, in an instance in which said third sensor has detected the presence of a sheet during the interval in which said image-forming operation is halted.

8. An apparatus according to claim 7, wherein said restarting means restarts said image forming operation halted by said halting means, when said third sensor comes to detect the absence of a sheet after said sheet-discharging operation.

9. An apparatus according to claim 3, wherein said transfer unit includes:

a transfer drum located adjacent to said photoconductor, circumferentially retaining a sheet thereon fed by said sheet-feeding path;

a transfer charger located within said transfer drum in an opposed position to the photoconductor;

a charger for electrically charging the surface of said transfer drum at a predetermined potential; and a separation charger for releasing the retention of a sheet from said transfer drum.

10. An apparatus according to claim 9, wherein said sheet-jam registering means includes a third sensor provided adjacent to said transfer drum, for detecting the presence of a sheet retained on said transfer unit.

11. An apparatus according to claim 10, wherein said sheet-jam registering means concludes the existence of a jammed-sheet condition in said transfer unit when said first detecting means and/or said second detecting means detects the presence of a jammed-sheet condition, and when said third sensor determines the existence of a jammed-sheet condition through the detection of the presence of a sheet by said third sensor.

12. An apparatus according to claim 11, further including means for halting an image-forming operation of the apparatus when said first and/or second detecting means detects the presence of a jammed-sheet condition; and means for restarting of the image-forming operation.

13. An apparatus according to claim 12, wherein said restarting means activates said transfer unit to discharge a sheet, in an instance in which said third sensor has detected the presence of a sheet during the interval in which said image-forming operation is halted.

14. An apparatus according to claim 13, wherein said restarting means restarts said image forming operation halted by said halting means, when said third sensor comes to detect the absence of a sheet after said sheet-discharging operation.

15. An apparatus according to claim 1, further including a display means for displaying a location of a jammed sheet condition in said transfer unit upon registration of a jammed sheet condition in said transfer unit by said registering means.

16. An apparatus for forming an image comprising:

image-formation means including a rotating photoconductor, and an image transfer unit retaining a sheet on its circumferential surface;

a sheet-feeding path for feeding a sheet to said transfer unit;

a sheet-discharging path for discharging the sheet from said transfer unit;

first detecting means for detecting a jammed-sheet condition in said sheet-feeding path;

second detecting means for detecting a jammed-sheet condition in said sheet-discharging path; and sheet jam registering means which also registers a jammed-sheet condition in said image transfer unit upon detection of a jammed sheet condition by either of said first detecting means or said second detecting means;

means for activating said image transfer unit to discharge a jammed sheet therein in response to registering of a jammed-sheet condition by said sheet jam registering means.

17. An apparatus according to claim 16, wherein said first detecting means includes a first sensor disposed in said sheet-feeding path, whereby a jammed-sheet condition occurring in said sheet-feeding path is concluded after a predetermined period of continuous detection by said first sensor has elapsed.

18. An apparatus according to claim 16, wherein said second detecting means includes a second sensor disposed in said sheet-discharging path, whereby a jammed-sheet condition occurring in said sheet-discharging path is concluded after a predetermined period of continuous detection by said second sensor has elapsed.

19. An apparatus according to claim 16, wherein said sheet-jam registering means includes a third sensor provided adjacent to said transfer unit, for detecting the presence of a sheet held in circumferential retention by said transfer unit.

20. An apparatus according to claim 19, wherein said sheet-jam registering means concludes the existence of a jammed-sheet condition in said transfer unit when said first detecting means and/or said second detecting means determines the existence of a jammed-sheet condition, and when said third sensor determines the existence of a jammed-sheet condition through the detection of the presence of a sheet by said third sensor.

21. An apparatus according to claim 16, further including:

means for halting an image-forming operation of the apparatus when said first and/or second detecting means detects the presence of a jammed-sheet condition; and means for restarting of the image-forming operation.

22. An apparatus according to claim 21, wherein said restarting means restarts said image forming operation halted by said halting means, when said third sensor comes to detect the absence of a sheet after said sheet-discharging operation.

23. An apparatus according to claim 16, wherein said transfer unit includes:

a transfer drum located adjacent to said photoconductor, circumferentially retaining a sheet thereon fed by said sheet-feeding path;

a transfer charger located within said transfer drum in an opposed position to the photoconductor;

a charger for electrically charging the surface of said transfer drum at a predetermined potential; and a separation charger for releasing the retention of a sheet from said transfer drum.

24. An apparatus according to claim 16, further including a display means for displaying a location of a jammed sheet condition in said transfer unit upon registration of a jammed sheet condition in said transfer unit by said registering means.

25. An apparatus for forming an image comprising:

image-formation means including a rotating photoconductor, and an image transfer unit retaining a sheet on its circumferential surface;

a sheet-feeding path for feeding a sheet to said transfer unit;

a sheet-discharging path for discharging the sheet from said transfer unit;

first detecting means for detecting a jammed-sheet condition in said sheet-feeding path;

second detecting means for detecting a jammed-sheet condition in said sheet-discharging path; and sheet jam registering means which registers a jammed-sheet condition in either said sheet-feeding path or said sheet-discharging path, and which registers a jammed-sheet condition in said image transfer unit upon detection of a jammed sheet condition in said sheet-feeding path by said first detecting means or upon detection of a jammed sheet condition in said sheet-discharging path by said second detecting means;

means for activating said image transfer unit to discharge a sheet in said assumed jammed-sheet condition.

* * * * *